US011878843B2

(12) United States Patent
Wang

(10) Patent No.: US 11,878,843 B2
(45) Date of Patent: Jan. 23, 2024

(54) CUP WITH CUP LID AND DETACHABLE AND WASHABLE CUP LID

(71) Applicant: Shanghai Dream Houseware CO., Ltd., Shanghai (CN)

(72) Inventor: Zengyu Wang, Shanghai (CN)

(73) Assignee: SHANGHAI DREAM HOUSEWARE CO., LTD., Shanghai (CN)

( * ) Notice: Subject to any disclaimer, the term of this patent is extended or adjusted under 35 U.S.C. 154(b) by 222 days.

(21) Appl. No.: 17/446,172

(22) Filed: Aug. 27, 2021

(65) Prior Publication Data

US 2022/0081172 A1 Mar. 17, 2022

(30) Foreign Application Priority Data

Sep. 11, 2020 (CN) ..... 202021982089.3

(51) Int. Cl.

*B65D 43/02* (2006.01)
*B65D 51/16* (2006.01)
*B65D 43/26* (2006.01)

(52) U.S. Cl.

CPC ..... *B65D 43/0218* (2013.01); *B65D 43/26* (2013.01); *B65D 51/1611* (2013.01); *B65D 2543/00092* (2013.01); *B65D 2543/00555* (2013.01)

(58) Field of Classification Search

CPC .. B65D 39/10; B65D 51/1611; B65D 41/065; B65D 41/36; B65D 45/305; B65D 47/125; B65D 47/24; B65D 49/08; B65D 51/16

See application file for complete search history.

(56) References Cited

U.S. PATENT DOCUMENTS

| | | | | |
|---|---|---|---|---|
| 235,278 | A * | 12/1880 | Norton | B60K 15/0406 220/300 |
| 2006/0283896 | A1* | 12/2006 | Kasting | B65D 51/20 222/549 |
| 2017/0139216 | A1* | 5/2017 | Crenko | B65D 41/06 |
| 2017/0183131 | A1* | 6/2017 | Kishore Kumar | B65D 51/16 |
| 2019/0135505 | A1* | 5/2019 | Cain | B65D 51/1611 |
| 2019/0352165 | A1* | 11/2019 | Corstanje | B67D 1/0832 |

* cited by examiner

*Primary Examiner* — Jeffrey R Allen

(74) *Attorney, Agent, or Firm* — Bayramoglu Law Offices LLC

(57) ABSTRACT

A cup with a cup lid and a detachable and washable cup lid are provided. The detachable and washable cup lid includes an outer cover adapted to a cup body. A top inner wall of the outer cover protrudes downwards to form a clamping frame, a clamping groove is formed in an inner wall of the clamping frame, and a notch communicating with the clamping groove is formed in a bottom end of the clamping frame. An inner bolt vertically arranged in the outer cover. The top of the inner bolt is inserted in the clamping frame, a clamping block is formed at the top end of an outer wall of the inner bolt, and the clamping block is inserted into the clamping groove to limit and connect the inner bolt and the outer cover.

8 Claims, 9 Drawing Sheets

CUP WITH CUP LID AND DETACHABLE AND WASHABLE CUP LID

CROSS REFERENCE TO THE RELATED APPLICATIONS

This application is based upon and claims priority to Chinese Patent Application No. 202021982089.3, filed on Sep. 11, 2020, the entire contents of which are incorporated herein by reference.

TECHNICAL FIELD

The present invention relates to the field of containers, and in particular to a cup with a cup lid and a detachable and washable cup lid.

BACKGROUND

Generally, a cup lid in the prior art includes an outer cover, an inner bolt directly fixed to the outer cover, and other structures. Such structures cannot be disassembled due to a fixed connection thereamong. When the cup lid covers a cup body, the cup lid and the cover body are in a threaded connection, which causes much inconvenience in covering and uncovering the cup. Additionally, since the inner bolt under the outer cover goes deep into the cup body and comes into contact with the liquid in the cup body, the cup lid can hardly be detached for washing and is thus prone to dirt accumulation.

SUMMARY

The objective of the present invention is to provide a detachable and washable cup lid aiming at the defects in the prior art, which can solve the problem that a cup lid in the prior art is prone to dirt accumulation and can hardly be detached for washing.

To achieve the foregoing objective, the following technical solution is adopted.

The present invention provides a detachable and washable cup lid, including:

an outer cover adapted to a cup body, where a top inner wall of the outer cover protrudes downwards to form a clamping frame, a clamping groove is formed in the inner wall of the clamping frame, and a notch communicating with the clamping groove is formed in the bottom end of the clamping frame; and an inner bolt vertically arranged in the outer cover, where the top of the inner bolt is inserted into the clamping frame, a clamping block is formed at the top end of the outer wall of the inner bolt, the clamping block is inserted into the clamping groove to limit and connect the inner bolt and the outer cover; the clamping block is driven by rotating the inner bolt to rotate from the interior of the clamping groove to the notch and then to be disengaged from the clamping groove through the notch, such that the inner bolt and the outer cover are detached and disengaged.

Further improvements in the detachable and washable cup lid of the present invention also include:

an interior of the inner bolt is hollow, where a vertical groove is formed in a side wall of the inner bolt, a locking piece is vertically arranged in the vertical groove and is hinged to the inner bolt, the locking piece can rotate around a hinged portion, and the top end of the locking piece corresponds to the inner wall of the clamping frame;

a first spring with one end connected to the bottom end of the locking piece and the other end directed towards the interior of the inner bolt and connected to the inner bolt; and an elastic leakage-proof sleeve which is sleeved on the bottom end of the inner bolt and corresponds to the bottom of the vertical groove, where the elastic leakage-proof sleeve is bound to the bottom of the locking piece, and then the locking piece is driven to rotate around the hinged portion to allow the top end of the locking piece to jack up the inner wall of the clamping frame, so as to avoid relative rotation between the inner bolt and the outer cover; and the elastic leakage-proof sleeve is disengaged from the inner bolt to remove binding to the locking piece, the locking piece rotates around the hinged portion under the action of the first spring, and then the top end of the locking piece is driven to be disengaged from the clamping frame to allow the inner bolt and the outer cover to rotate relatively.

Further improvements in the detachable and washable cup lid of the present invention are as follows:

a top of the inner bolt is provided with an opening, and a bottom of the inner bolt is closed by a bottom plate, and an exhaust hole is formed in the bottom plate;

a through hole communicating with the inner bolt is formed in the top of the outer cover;

the detachable and washable cup lid further includes an exhaust valve, wherein a second spring is sleeved outside the exhaust valve, and the exhaust valve is inserted into the inner bolt through the through hole and protrudes from the exhaust hole, the second spring is connected between the top end of the exhaust valve and the bottom plate, a blocking ring is sleeved on a bottom end of the exhaust valve, the blocking ring blocks the exhaust hole, the exhaust valve is pressed to move downwards, then the blocking ring is driven to move downwards to be disengaged from the exhaust hole, and the exhaust hole is opened; and after the exhaust valve is released, the exhaust valve moves upwards to reset under an action of the second spring.

Further improvements in the detachable and washable cup lid of the present invention are as follows:

a pair of connecting lugs arranged on two opposite sides of the vertical groove are formed on the inner bolt; and a rotary shaft transversely penetrates through the pair of connecting lugs and the middle of the locking piece to achieve hinging.

Further improvements in the detachable and washable cup lid of the present invention are as follows:

a fixating plate directly opposite to the locking piece is formed in the inner bolt, and the fixating plate is fixedly connected to the other end of the first spring.

Further improvements in the detachable and washable cup lid of the present invention are as follows:

a circle of waterproof band is fixed to the inner wall of the cup body; and when the outer cover covers the cup body, the elastic leakage-proof sleeve is tightly attached to the waterproof band.

Further improvements in the detachable and washable cup lid of the present invention are as follows:

a cup rim sleeve is sleeved on the top of the cup body, and protruding blocks are formed on an outer wall of the cup rim sleeve;

a groove adapted to the protruding blocks is formed in an inner side wall of the outer cover, and a bottom side wall of the groove obliquely extends downwards to the bottom end of the outer cover; and when the outer cover covers the top of the cup body, the outer cover is rotated to allow the protruding block to move along the bottom side wall of the groove to be inserted into the groove, thereby achieving fixed connection.

The beneficial effects of the detachable and washable cup lid of the present invention are as follows:

the clamping groove is formed in the inner wall of the clamping frame of the outer cover, the notch communicating with the clamping groove is formed in the bottom end of the clamping frame, the top of the inner bolt is inserted in the clamping frame, and the clamping block of the inner bolt is inserted in the clamping groove to limit and connect the inner bolt and the outer cover; the clamping block is driven by rotating the inner bolt to rotate from the interior of the clamping groove to the notch and then to be disengaged from the clamping groove through the notch, such that the inner bolt and the outer cover are detached and disengaged. The inner bolt and the outer cover of the present invention can be detached and disengaged into dependent parts, which can not only facilitate washing and mounting, but also further solve the problem that a cup lid in the prior art is prone to dirt accumulation and can hardly be detached for washing.

DETAILED DESCRIPTION OF THE EMBODIMENTS

The present invention is described in more detail hereinafter with reference to the accompanying drawings and specific embodiments.

Figure 1:
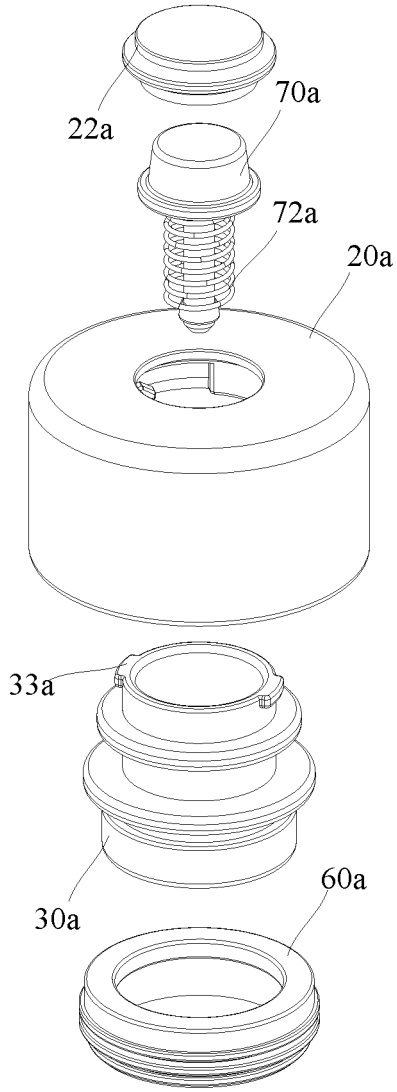
FIG. 1 is an exploded schematic diagram of the detachable and washable cup lid according to Embodiment 1 of the present invention.
Figure 2:
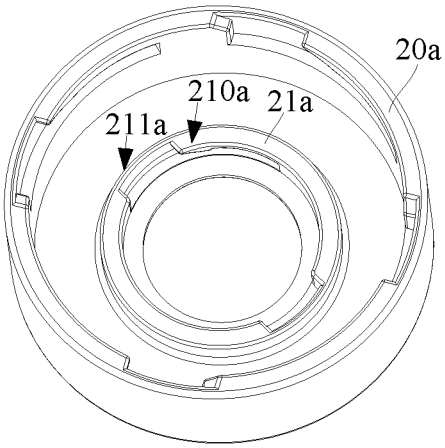
FIG. 2 is a diagram of an outer cover of the detachable and washable cup lid according to Embodiment 1 of the present invention.
Figure 3:
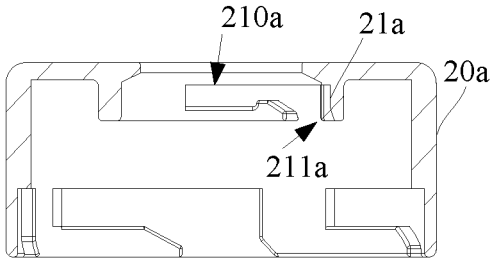
FIG. 3 is a sectional view of an outer cover of the detachable and washable cup lid according to Embodiment 1 of the present invention.
Figure 4:
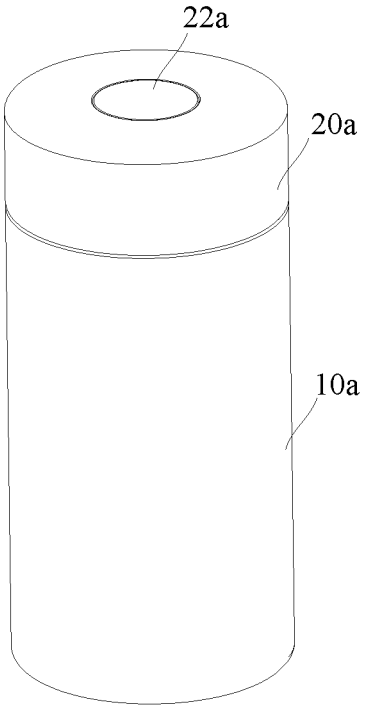
FIG. 4 is a perspective view illustrating the detachable and washable cup lid covering a cup body according to Embodiment 1 of the present invention.
Figure 5:
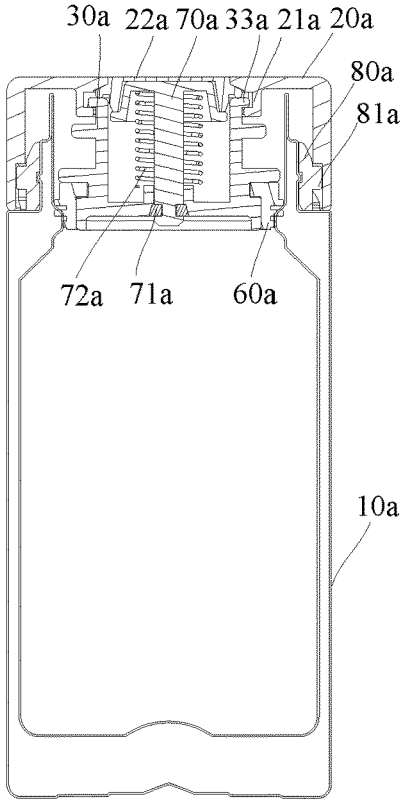
FIG. 5 is a sectional view of FIG. 4.
Figure 6:
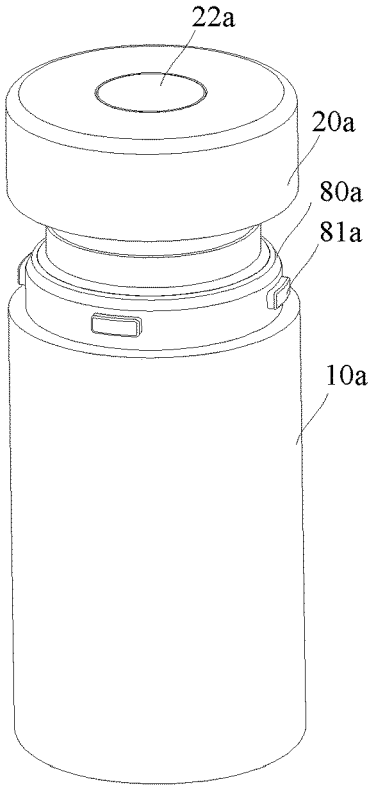
FIG. 6 is a perspective view illustrating the detachable and washable cup lid disengaged from the cup body according to Embodiment 1 of the present invention.
Figure 7:
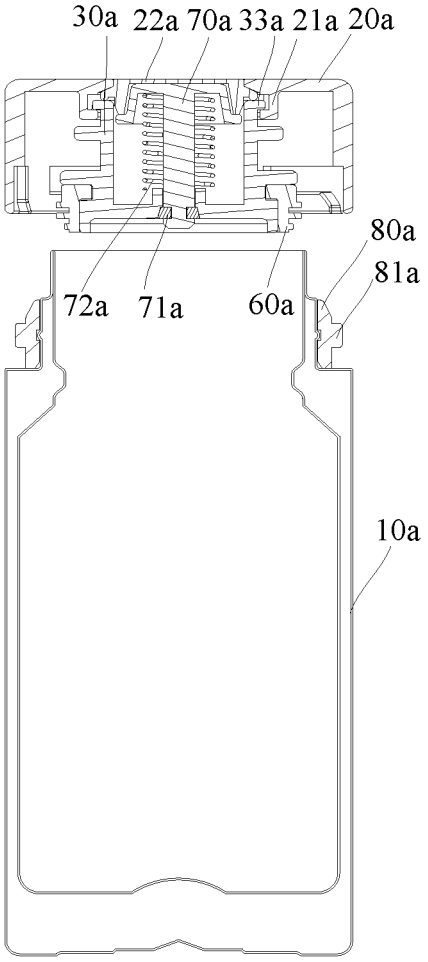
FIG. 7 is a sectional view of FIG. 6.

FIG. 1 illustrates an exploded schematic diagram of the detachable and washable cup lid according to Embodiment 1 of the present invention. FIG. 2 is a diagram of an outer cover of the detachable and washable cup lid according to Embodiment 1 of the present invention. FIG. 3 is a sectional view of an outer cover of the detachable and washable cup lid according to Embodiment 1 of the present invention. FIG. 4 is a perspective view illustrating the detachable and washable cup lid covering a cup body according to Embodiment 1 of the present invention. FIG. 5 is a sectional view of FIG. 4. FIG. 6 is a perspective view illustrating the detachable and washable cup lid disengaged from the cup body according to Embodiment 1 of the present invention. FIG. 7 is a sectional view of FIG. 6. As shown in FIG. 1 to FIG. 7, the detachable and washable cup lid of the present invention includes:

an outer cover 20*a* adapted to a cup body 10*a*, where a top inner wall of the outer cover 20*a* protrudes downwards to form a clamping frame 21*a*, a clamping groove 210 is formed in the inner wall of the clamping frame 21*a*, and a notch 211*a* communicating with the clamping groove 210*a* is formed in the bottom end of the clamping frame 21*a*; and an inner bolt 30*a* vertically arranged in the outer cover 20*a*, where the top of the inner bolt 30*a* is inserted into the clamping frame 21*a*, a clamping block 33*a* is formed at the top end of the outer wall of the inner bolt 30*a*, and the clamping block 33*a* can be inserted into the clamping groove to limit and connect the inner bolt 30*a* and the outer cover 20*a*; the clamping block 33*a* is driven by rotating the inner bolt 30*a* to rotate from the interior of the clamping groove 210*a* to the notch 211*a* and then to be disengaged from the clamping groove 210 through the notch, such that the inner bolt 30*a* and the outer cover 20*a* are detached and disengaged.

The inner bolt and the outer cover of the present invention can be detached and disengaged into dependent parts, which can not only facilitate washing and mounting, but also further solve the problem that a cup lid in the prior art is prone to dirt accumulation and can hardly be detached for washing.

As a preferred embodiment of the detachable and washable cup lid of the present invention, the inner bolt 30*a* is hollow inside, and is provided with an opening at the top and closed by a bottom plate at the bottom, and an exhaust hole is formed in the bottom plate; a through hole communicating with the inner bolt 30*a* is formed in the top of the outer cover 20*a*; the detachable and washable cup lid further includes an exhaust valve 70*a*, where a second spring 72*a* is sleeved outside the exhaust valve 70*a*, the exhaust valve 70*a* is inserted into the inner bolt 30*a* through the through hole and protrudes from the exhaust hole, the second spring 72*a* is connected between the top end of the exhaust valve 70*a* and the bottom plate, a blocking ring 71*a* is sleeved on the bottom end of the exhaust valve 70*a*, the blocking ring 71*a* blocks the exhaust hole, and by pressing the exhaust valve 70*a* to move downwards, the blocking ring 71*a* is driven to move downwards to be disengaged from the exhaust hole, such that the exhaust hole is opened; and after releasing the exhaust valve 70*a*, the exhaust valve 70*a* moves upwards to reset under the action of the second spring 72*a*.

When the cup body is filled with hot water, temperature reduction and hot expansion and cold contraction come along. A pressure difference is generated between the inside and the outside of the cup body when the external atmospheric pressure is significantly higher than the atmospheric pressure inside the cup body, which makes it hard to open the cover body. By pressing the arranged exhaust valve 70*a* to move downwards, the blocking ring 71*a* is driven to disengage itself from the exhaust hole, in this way, the exhaust hole is opened and a balance of atmospheric pressure inside and outside the cup body is reached, such that the cup lid can be conveniently opened.

Particularly, the exhaust valve 70*a* is a cylindrical rod, the caliber of the exhaust hole in the bottom plate is slightly greater than the outer diameter of the bottom end of the exhaust valve 70*a*, then the exhaust valve 70*a* moves downwards to drive the blocking ring 71*a* to disengage itself from the exhaust hole, in this way, the exhaust hole is opened for exhaust, and meanwhile, insertion and up-and-down movement of the exhaust valve 70*a* are also facilitated.

The blocking ring 71*a* is a silicon rubber casing sleeving the bottom end of the exhaust valve 70*a*. By blocking the notch between the exhaust valve 70*a* and the bottom plate with the silicon rubber casing, leakage is avoided.

Further, a sleeve corresponding to the exhaust hole is fixed to the upper side of the bottom plate, and the exhaust valve 70*a* penetrates through the sleeve and is attached to the inner wall of the sleeve, such that the effects of leakage and guiding are achieved.

As a preferred embodiment of the detachable and washable cup lid of the present invention, brims protruding from the exhaust valve 70*a* are formed at the circumferential side of the top of the exhaust valve 70*a* and are used for limiting the top end of the second spring 72*a*, and the bottom end of the second spring 72*a* abuts against the sleeve at the upper side of the bottom plate for limiting. The second spring 72*a* is compressed when the exhaust valve 70*a* is pressed to move downwards, and after pressing is stopped, the exhaust valve 70*a* moves upwards to reset under the elastic effect of the second spring 72*a*.

As a preferred embodiment of the detachable and washable cup lid of the present invention, the detachable and washable cup lid further includes a button 22*a* which is formed at the through hole and is in splice joint with the outer cover 20*a*, and the button 22*a* covers the top of the exhaust valve 70*a*; the edge of the button 22*a* obliquely and protrudes downwards to form a limiting ring which is arranged on a top inner wall of the outer cover 20*a* in a blocking manner, and the top face of the button 22*a* is flush with that of the outer cover 20*a*. The button 22*a* is limited by being arranged on the top inner wall of the outer cover 20*a* in a blocked manner through the limiting ring at the edge, such that the button 22*a* is prevented from falling off. The button 22*a*, which is made of a flexible material, can be deformed through pressing, such that the exhaust valve 70*a* can be further pressed.

As a preferred embodiment of the detachable and washable cup lid of the present invention, the outer cover 20*a* covers the top of the cup body 10*a* and covers the cup rim; the inner bolt 30*a* is inserted in the cup body 10*a* through the cup rim; a circle of waterproof band is fixed to the inner wall of the cup body 10*a*; when the outer cover covers the cup body, the elastic leakage-proof sleeve 60*a* is tightly attached to the waterproof band, and can be elastically deformed to block a notch between the inner wall of the cup body 10*a* and a contact face of the inner bolt 30*a*, thereby avoiding leakage.

As a preferred embodiment of the detachable and washable cup lid of the present invention, the top of the cup body 10*a* is covered with a cup rim sleeve 80*a*, and the protruding blocks 81*a* are formed on an outer wall of the cup rim sleeve 80*a*; a groove adapted to the protruding blocks 81*a* is formed in an inner side wall of the outer cover 20*a*, and a bottom side wall of the groove obliquely extends downwards to the bottom end of the outer cover 20*a*; and when the outer cover 20*a* sleeves the top of the cup body 10*a*, rotating the outer cover 20*a* enables the protruding blocks 81*a* to move along the bottom side wall of the groove to be inserted into the groove, thereby achieving fixed connection.

Further, the elastic leakage-proof sleeve 60*a* sleeves the bottom of the inner bolt 30*a*. Particularly, there are at least four protruding blocks 81*a* spaced apart on the outer wall of the cup rim sleeve 80*a*. By pressing hardly the outer cover 20*a* and rotating the same by 45°, the protruding blocks 81*a* are moved along the bottom side wall of the groove to be inserted in the groove; the elastic leakage-proof sleeve 60*a* is tightly attached to the waterproof band, which can not only prevent water seepage, but also can produce upward counter-acting force; and then overall upward acting force is exerted on the outer cover to enable the protruding blocks 81*a* to be tightly attached to the groove of the outer cover 20*a*, and in this way, the effects of covering and fixed connection are achieved. The outer cover 20*a* and the cup body 10*a* can be disengaged from each other simply by pressing hardly the outer cover 20*a* downwards and rotating the same, and moving the protruding blocks 81*a* out of the groove along the bottom side wall of the groove, and in this way, the situation is avoided that due to a thread design adopted in the prior art, the outer cover 20*a* can be opened only after being rotated for several circles.

Further, a horizontal bearing plate for bearing the bottom end of the outer cover 20*a* is formed on the cup body 10*a*. After the cup body 10*a* is covered with the outer cover 20*a*, the side wall of the outer cover 20*a* is flush with that of the cup body 10*a*, such that overall aesthetics is guaranteed.

The present invention further provides a detachment method of the detachable and washable cup lid, including the following steps:

relatively rotating the inner bolt 30*a* and the outer cover 20*a*, and driving the clamping block 33*a* to rotate from the interior of the clamping groove to the notch; and moving the inner bolt 30*a* towards the bottom end of the outer cover 20*a*, and driving the clamping block 33*a* to move out of the notch to disengage itself from the clamping groove, such that the inner bolt 30*a* and the outer cover 20*a* are detached and disengaged.

Figure 8:
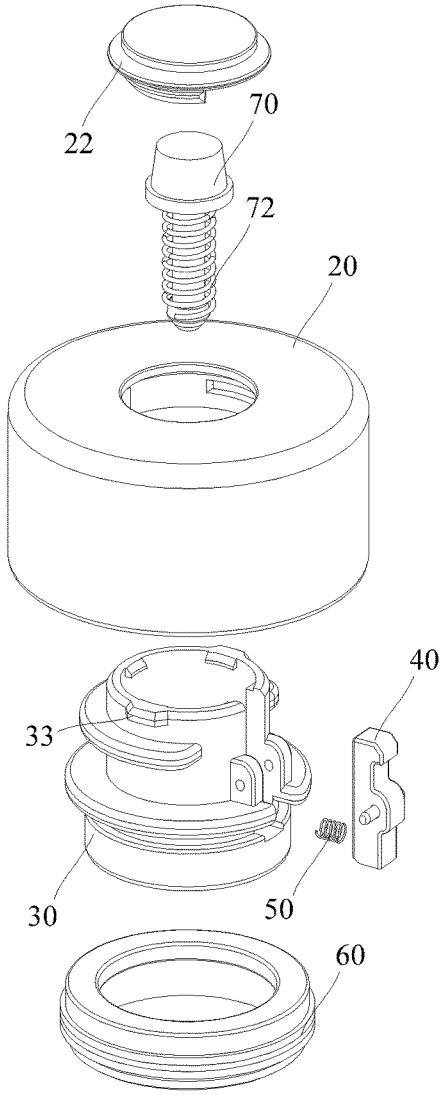
FIG. 8 is an exploded schematic diagram of the detachable and washable cup lid according to Embodiment 2 of the present invention.
Figure 9:
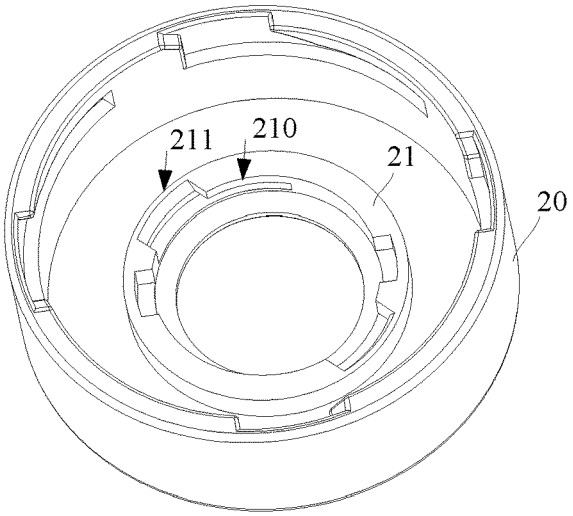
FIG. 9 is a diagram of an outer cover of the detachable and washable cup lid according to Embodiment 2 of the present invention.
Figure 10:
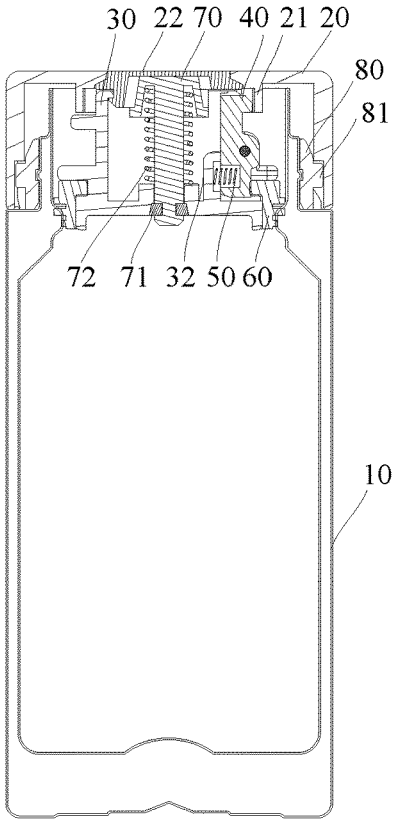
FIG. 10 and FIG. 11 are a cross sectional view and a lateral sectional view illustrating the detachable and washable cup lid covering the cup body according to Embodiment 2 of the present invention.
Figure 11:
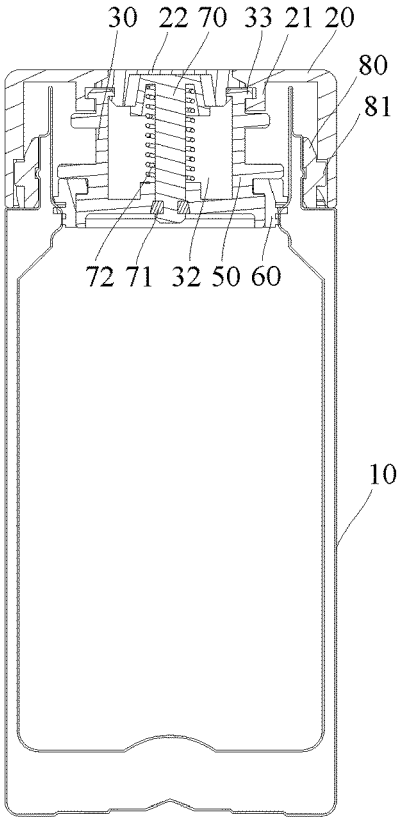
Figure 12:
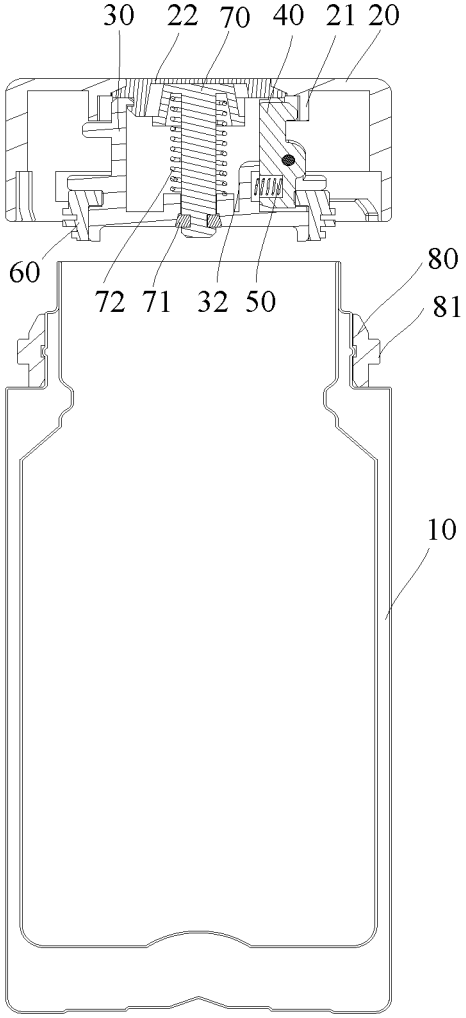
FIG. 12 and FIG. 13 are a cross sectional view and a lateral sectional view illustrating the detachable and washable cup lid disengaged from a cup body according to Embodiment 2 of the present invention.
Figure 13:
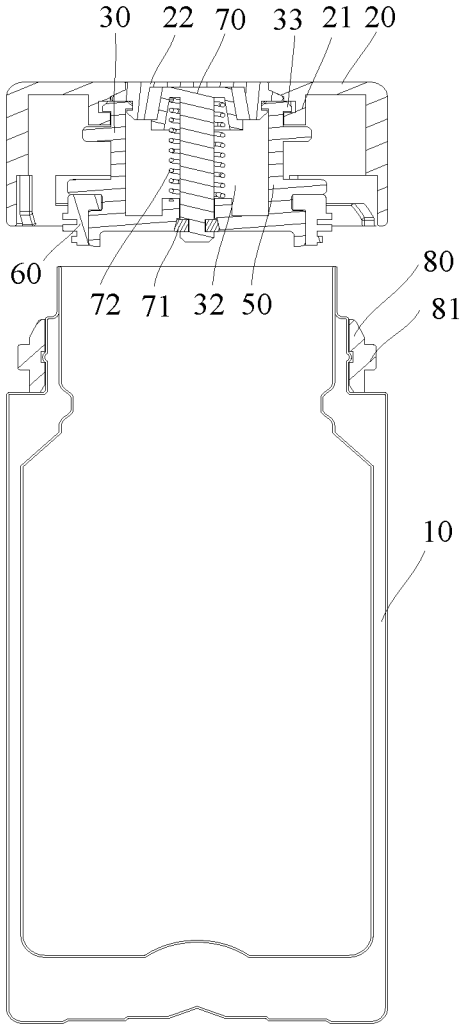

The detachable and washable cup lid of the present invention further includes Embodiment 2. FIG. 8 is an exploded schematic diagram of the detachable and washable cup lid according to Embodiment 2 of the present invention. FIG. 9 is a diagram of an outer cover of the detachable and washable cup lid according to Embodiment 2 of the present invention. FIG. 10 and FIG. 11 are a cross sectional view and a lateral sectional view illustrating the detachable and washable cup lid covering the cup body according to Embodiment 2 of the present invention. FIG. 12 and FIG. 13 are a cross sectional view and a lateral sectional view illustrating the detachable and washable cup lid disengaged from a cup body according to Embodiment 2 of the present invention. As shown in FIG. 9 to FIG. 13, an inner bolt 30 is hollow inside, and a vertical groove is formed in the side wall of the inner bolt 30; the detachable and washable cup lid further includes a locking piece 40, where the locking piece is vertically arranged in the vertical groove and hinged to the inner bolt 30 and can rotate around a hinged portion, and the top end of the locking piece 40 corresponds to the inner wall of a clamping frame 21; a first spring 50, where one end of the first spring is connected to the bottom end of the locking piece 40, and the other end of the first spring 50 points to the interior of the inner bolt 30 and is connected to the inner bolt 30; and an elastic leakage-proof sleeve 60, where the elastic leakage-proof sleeve sleeves the bottom end of the inner bolt 30 and corresponds to the bottom of the vertical groove, the elastic leakage-proof sleeve 60 is bound to the bottom of the locking piece 40, and drives the locking piece 40 to rotate around the hinged portion to enable the top end of the locking piece 40 to jack up the inner wall of the clamping frame 21, so as to avoid relative rotation between the inner bolt 30 and the outer cover 20; and by disengaging the elastic leakage-proof sleeve 60 from the inner bolt 30 to remove binding on the locking piece 40, the locking piece 40 rotates around the hinged portion under the action of the first spring 50, then the top end of the locking piece 40 is driven to be disengaged from the clamping frame 21, such that the inner bolt 30 and the outer cover 20 can rotate relatively.

Further, by hinging the locking piece to the side wall of the inner bolt and sleeving the inner bolt with the elastic leakage-proof sleeve, the bottom of the locking piece is pressed and constrained, the top of the locking piece is rotated towards the outer side around the hinged portion, and when the top of the inner bolt is inserted in the clamping frame of the outer cover, the top of the locking piece jacks up the inner wall of the clamping frame of the outer cover to limit and connect the locking piece and the outer cover, and the situation is avoided that the inner bolt and the outer cover are detached by accident after being rotated relatively due to negligence.

The elastic leakage-proof sleeve is disengaged from the inner bolt to remove binding to the locking piece, where the locking piece rotates around the hinged portion under the action of the first spring, and then the top end of the locking piece is driven to be disengaged from the clamping frame to allow the inner bolt and the outer cover to rotate relatively. The clamping block is driven by relatively rotating the inner bolt and the outer cover to rotate from the interior of the clamping groove to the notch and then to be disengaged from the clamping groove through the notch, such that the inner bolt can be taken out. The inner bolt and the outer cover of the present invention can be detached and disengaged into dependent parts, such that washing and mounting are facilitated, and thus the problem is solved by the present invention that a cup lid in the prior art is prone to dirt accumulation and can hardly be detached for washing.

As a preferred embodiment of the detachable and washable cup lid of the present invention, the inner bolt 30 is provided with an opening at the top and is closed by a bottom plate at the bottom, and an exhaust hole is formed in the bottom plate; a through hole communicating with the inner bolt 30 is formed in the top of the outer cover 20; the detachable and washable cup lid further includes an exhaust valve 70, where a second spring 72 is sleeved outside the exhaust valve 70, the exhaust valve 70 is inserted into the inner bolt 30 through the through hole and protrudes from the exhaust hole, the second spring 72 is connected between the top end of the exhaust valve 70 and the bottom plate, the bottom end of the exhaust valve 70 is sleeved with a blocking ring 71, the blocking ring 71 blocks the exhaust hole, and by pressing the exhaust valve 70 to move downwards, the blocking ring 71 is driven to move downwards to be disengaged from the exhaust hole, such that the exhaust hole is opened; and after releasing the exhaust valve 70, the exhaust valve 70 moves upwards to reset under the action of the second spring 72.

When the cup body is filled with hot water, temperature reduction and hot expansion and cold contraction come along. A pressure difference is generated between the inside and the outside of the cup body when the external atmospheric pressure is significantly higher than the atmospheric pressure inside the cup body, which makes it hard to open the cover body. By pressing the arranged exhaust valve 70 to move downwards, the blocking ring 71 is driven to disengage itself from the exhaust hole, in this way, the exhaust hole is opened and a balance of atmospheric pressure inside and outside the cup body is reached, such that the cup lid can be conveniently opened.

Particularly, the exhaust valve 70 is a cylindrical rod, the caliber of the exhaust hole in the bottom plate is slightly greater than the outer diameter of the bottom end of the exhaust valve 70, then the exhaust valve 70 moves downwards to drive the blocking ring 71 to disengage itself from the exhaust hole, in this way, the exhaust hole is opened for exhaust, and meanwhile, insertion and up-and-down movement of the exhaust valve 70 are also facilitated.

The blocking ring 71 is a silicon rubber casing sleeving the bottom end of the exhaust valve 70. By blocking the notch between the exhaust valve 70 and the bottom plate with the silicon rubber casing, leakage is avoided.

Further, a sleeve corresponding to the exhaust hole is fixed to the upper side of the bottom plate, and the exhaust valve 70 penetrates through the sleeve and is attached to the inner wall of the sleeve, such that the effects of leakage and guiding are achieved.

As a preferred embodiment of the detachable and washable cup lid of the present invention, brims protruding from the exhaust valve 70 are formed at the circumferential side of the top of the exhaust valve 70 and are used for limiting the top end of the second spring 72, and the bottom end of the second spring 72 abuts against the sleeve at the upper side of the bottom plate for limiting. The second spring 72 is compressed when the exhaust valve 70 is pressed to move downwards, and after pressing is stopped, the exhaust valve 70 moves upwards to reset under the elastic effect of the second spring 72.

As a preferred embodiment of the detachable and washable cup lid of the present invention, the detachable and washable cup lid further includes a button 22 which is formed at the through hole and is in splice joint with the outer cover 20, and the button 22 covers the top of the exhaust valve 70; the edge of the button 22 obliquely and protrudes downwards to form a limiting ring which is arranged on a top inner wall of the outer cover 20 in a blocking manner, and the top face of the button 22 is flush with that of the outer cover 20. The button 22 is limited by being arranged on a top inner wall of the outer cover 20 in a blocked manner through the limiting ring at the edge, such that the button 22 is prevented from falling off. The button 22, which is made of a flexible material (i.e., flexible glue), can be deformed through pressing, such that the exhaust valve 70 can be further pressed.

As a preferred embodiment of the detachable and washable cup lid in the present invention, a pair of connecting lugs 31 arranged on two opposite sides of the vertical groove are formed on the inner bolt 30; a rotary shaft transversely penetrates through the pair of connecting lugs and the middle of the locking piece 40 to achieve hinging; and a fixating plate 32 directly opposite to the locking piece 40 is formed in the inner bolt 30, and is connected to the other end of the first spring 50. The locking piece 40 can rotate towards the inside or outside of the inner bolt 30 around the rotary shaft.

Further, the top of the inner bolt 30 is cut downwards into a strip-shaped vertical groove, and the bottom face of the vertical groove is spaced apart from the bottom end of the inner bolt 30 by a certain distance. The locking piece 40 is in a strip shape adapted to the vertical groove. A protrusion is formed outside the top end of the locking piece 40 to jack up the inner wall of the outer cover 20 to limit and connect the inner bolt 30 and the outer cover 20.

Further, an upper ring plate and a lower ring plate which are in a circular shape are also formed on an outer wall of the inner bolt 30 up and down, where, the upper ring plate abuts against the bottom end of the clamping frame of the outer cover, and the lower ring plate abuts against the upper end of the elastic leakage-proof sleeve 60, such that limiting is conducted.

Further, the elastic leakage-proof sleeve 60 is a silicon rubber casing. The elastic leakage-proof sleeve is bound to the outer wall of the inner bolt 30 by utilizing elastic deformation of the silicon rubber casing, such that the bottom end of the locking piece 40 can be limited to prevent the bottom end of the locking piece 40 from rotating outwards under the action of the first spring 50.

As a preferred embodiment of the detachable and washable cup lid in the present invention, the outer cover 20 covers the top of the cup body 10 and covers the cup rim; the inner bolt 30 is inserted in the cup body 10 through the cup rim; a circle of waterproof band is fixed to the inner wall of the cup body 10; and the elastic leakage-proof sleeve 60 is tightly attached to the waterproof band, and can be elastically deformed to block a notch between the inner wall of the cup body 10 and a contact face of the inner bolt 30, thereby avoiding leakage.

As a preferred embodiment of the detachable and washable cup lid in the present invention, the top of the cup body 10*a* is covered with a cup rim sleeve 80, and the protruding blocks 81 are formed on an outer wall of the cup rim sleeve 80; a groove adapted to the protruding blocks 81 is formed in an inner side wall of the outer cover 20, and the bottom side wall of the groove obliquely extends downwards to the bottom end of the outer cover 20; and when the outer cover 20 covers the top of the cup body 10, rotating the outer cover 20 enables the protruding blocks 81 to move along the bottom side wall of the groove to be inserted into the groove, thereby achieving fixed connection.

Further, there are at least four protruding blocks 81 spaced apart on the outer wall of the cup rim sleeve 80. By pressing hardly the outer cover 20 and rotating the same by 45°, the protruding blocks 81 are moved along the bottom side wall of the groove to be inserted in the groove; the elastic leakage-proof sleeve 60 is tightly attached to the waterproof band to produce upward counter-acting force; and then overall upward acting force is exerted on the outer cover to enable the protruding blocks 81 to be tightly attached to the groove of the outer cover 20, and in this way, the effects of covering and fixed connection are achieved. The outer cover 20 and the cup body 10 can be disengaged from each other simply by pressing hardly the outer cover 20 downwards and rotating the same, and moving the protruding blocks 81 out of the groove along the bottom side wall of the groove, and in this way, the situation is avoided that due to a thread design adopted in the prior art, the outer cover 20 can be opened only after being rotated for several circles.

Further, a horizontal bearing plate for bearing the bottom end of the outer cover 20 is formed on the cup body 10. After the cup body 10 is covered with the outer cover 20, the side wall of the outer cover 20 is flush with that of the cup body 10, such that overall aesthetics is guaranteed.

The present invention further provides a detachment method of the detachable and washable cup lid, including the following steps:

- disengaging the elastic leakage-proof sleeve 60 from the inner bolt 30 to remove binding to the locking piece 40, such that the inner bolt 30 and the outer cover 20 can rotate relatively;
- relatively rotating the inner bolt 30 and the outer cover 20, and driving the clamping block 33 to rotate from the interior of the clamping groove to the notch; and
- moving the inner bolt 30 towards the bottom end of the outer cover 20, and driving the clamping block 33 to move out of the notch to disengage itself from the clamping groove, such that the inner bolt 30 and the outer cover 20 are detached and disengaged.

The beneficial effects of the detachable and washable cup lid of the present invention are as follows:

- the clamping groove is formed in the inner wall of the clamping frame of the outer cover, the notch communicating with the clamping groove is formed in the bottom end of the clamping frame, the top of the inner bolt is inserted in the clamping frame, and the clamping block of the inner bolt is inserted in the clamping groove to limit and connect the inner bolt and the outer cover; the clamping block is driven by rotating the inner bolt to rotate from the interior of the clamping groove into the notch and then to be disengaged from the clamping groove through the notch, such that the inner bolt and the outer cover are detached and disengaged.

Further, by hinging the locking piece to the side wall of the inner bolt and sleeving the inner bolt with the elastic leakage-proof sleeve, the bottom of the locking piece is pressed and constrained, the top of the locking piece is rotated towards the outer side around the hinged portion, and when the top of the inner bolt is inserted in the clamping frame of the outer cover, the top of the locking piece jacks up the inner wall of the clamping frame of the outer cover to limit and connect the locking piece and the outer cover, and the situation is avoided that the inner bolt and the outer cover are detached after being rotated accidentally.

The elastic leakage-proof sleeve is disengaged from the inner bolt to remove binding to the locking piece, where the locking piece rotates around the hinged portion under the action of the first spring, and then the top end of the locking piece is driven to be disengaged from the clamping frame to allow the inner bolt and the outer cover to rotate relatively. By relatively rotating the inner bolt and the outer cover, the clamping block is driven to rotate from the interior of the clamping groove to the notch and then to be disengaged from the clamping groove through the notch, such that the inner bolt can be taken out. The inner bolt and the outer cover of the present invention can be detached and disengaged into dependent parts, which can not only facilitate washing and mounting, but also further solve the problem that a cup lid in the prior art is prone to dirt accumulation and can hardly be detached for washing.

Figure 14:
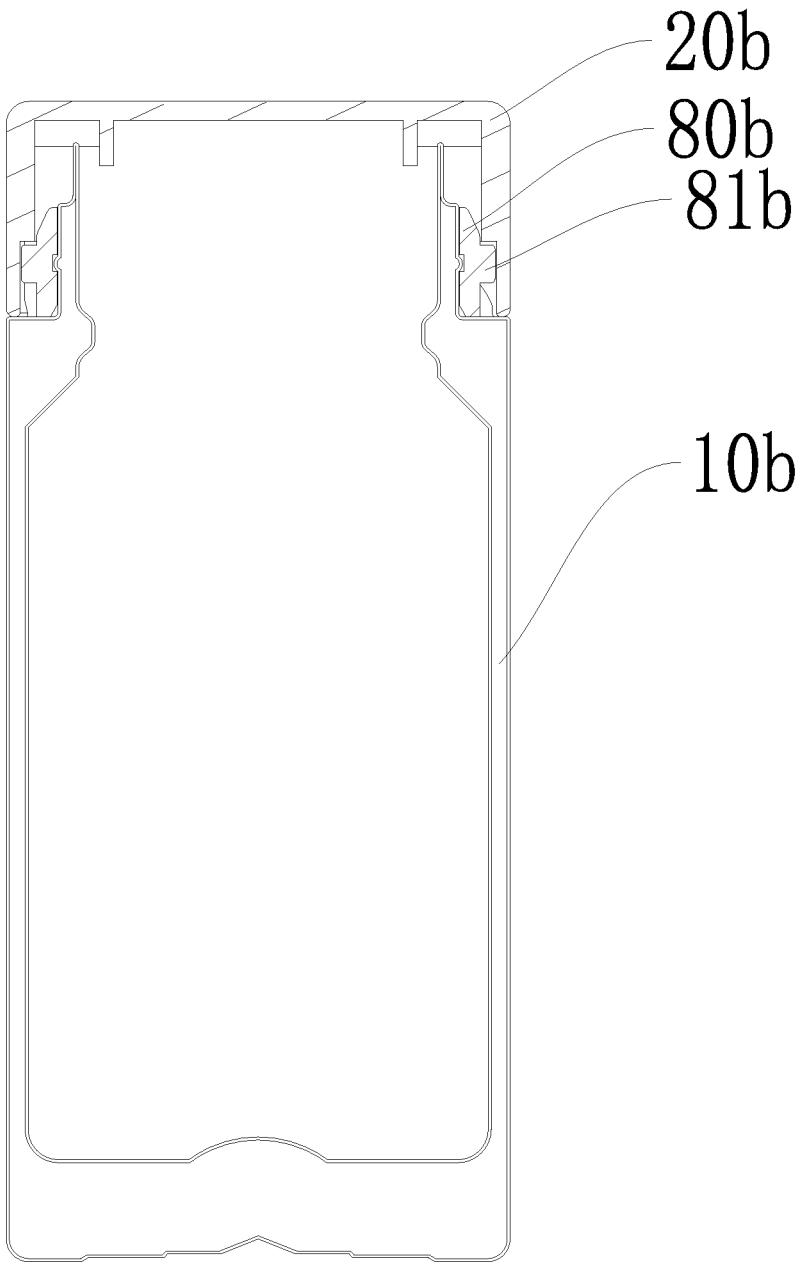
FIG. 14 is a cross sectional view illustrating the cup lid covering the cup body.

As shown in FIG. 14, the present invention provides an embodiment of a cup with a cup lid, including a cup body 10*b*, a cup lid 20*b*, and a cup rim sleeve 80*b* covering the top of the cup body 10*b*, where protruding block 81*b* are formed on an outer wall of the cup rim sleeve; a groove adapted to the protruding blocks 81*b* is formed in an inner side wall of the cup lid 20*b*, and the bottom side wall of the groove obliquely extends downwards to the bottom end of the cup lid 20*b*; and when the cup lid 20*b* covers the top of the cup body 10*b*, rotating the cup lid 20*b* enables the protruding blocks 81*b* to move along the bottom side wall of the groove to be inserted into the groove, thereby achieving fixed connection.

The present invention is described in detail in combination with the embodiments in the accompanying drawings, and persons of ordinary skill in the art may make various changes to the present invention according to the above description. Therefore, some details in the embodiments shall not be regarded as restrictive to the present invention, and the scope defined in the claims shall be deemed as a scope of protection of the present invention.

What is claimed is:

1. A detachable and washable cup lid, comprising:

an outer cover adapted to a cup body, wherein a top inner wall of the outer cover protrudes downwards to form a clamping frame, a clamping groove is formed in an inner wall of the clamping frame, and a notch communicating with the clamping groove is formed in a bottom end of the clamping frame;

an inner bolt vertically arranged in the outer cover, wherein a top of the inner bolt is inserted into the clamping frame, a clamping block is formed at a top end of an outer wall of the inner bolt, the clamping block is inserted into the clamping groove to limit and connect the inner bolt and the outer cover; the clamping block is driven by rotating the inner bolt to rotate from an interior of the clamping groove to the notch and then to be disengaged from the clamping groove through the notch, to allow the inner bolt and the outer cover to be detached and disengaged;

a locking piece, wherein an interior of the inner bolt is hollow, a vertical groove is formed in a side wall of the inner bolt, the locking piece is vertically arranged in the vertical groove and is hinged to the inner bolt, the locking piece rotates around a hinged portion, and a top end of the locking piece corresponds to the inner wall of the clamping frame;

a first spring, wherein a first end of the first spring is connected to a bottom end of the locking piece, and a second end of the first spring is directed towards the interior of the inner bolt and is connected to the inner bolt; and an elastic leakage-proof sleeve, wherein the elastic leakage-proof sleeve is sleeved on a bottom end of the inner bolt and corresponds to a bottom of the vertical groove, the elastic leakage-proof sleeve is bound to a bottom of the locking piece, the elastic leakage-proof sleeve drives the locking piece to rotate around the hinged portion to allow the top end of the locking piece to jack up the inner wall of the clamping frame, to avoid relative rotation between the inner bolt and the outer cover;

wherein the elastic leakage-proof sleeve is disengaged from the inner bolt to remove binding to the locking piece, the locking piece rotates around the hinged portion under an action of the first spring, and then the top end of the locking piece is driven to be disengaged from the clamping frame to allow the inner bolt and the outer cover to rotate relatively.

2. The detachable and washable cup lid according to claim 1, further comprising an exhaust valve, wherein, a top of the inner bolt is provided with an opening, and a bottom of the inner bolt is closed by a bottom plate, and an exhaust hole is formed in the bottom plate;

a through hole communicating with the inner bolt is formed in a top of the outer cover;

a second spring is sleeved outside the exhaust valve;

the exhaust valve is inserted into the inner bolt through the through hole and protrudes from the exhaust hole;

the second spring is connected between a top end of the exhaust valve and the bottom plate;

a blocking ring is sleeved on a bottom end of the exhaust valve, and the blocking ring blocks the exhaust hole;

the exhaust valve is pressed to move downwards, then the blocking ring is driven to move downwards to be disengaged from the exhaust hole, and the exhaust hole is opened; and after the exhaust valve is released, the exhaust valve moves upwards to reset under an action of the second spring.

3. The detachable and washable cup lid according to claim 1, wherein, a pair of connecting lugs arranged on two opposite sides of the vertical groove are formed on the inner bolt; and a rotary shaft transversely penetrates through the pair of connecting lugs and a middle of the locking piece to achieve hinging.

4. The detachable and washable cup lid according to claim 1, wherein, a fixating plate directly opposite to the locking piece is formed in the inner bolt, and the fixating plate is fixedly connected to the second end of the first spring.

5. The detachable and washable cup lid according to claim 1, wherein, a circle of waterproof band is fixed to an inner wall of the cup body; and when the outer cover covers the cup body, the elastic leakage-proof sleeve is tightly attached to the circle of waterproof band.

6. The detachable and washable cup lid according to claim 1, wherein, a cup rim sleeve is sleeved on a top of the cup body, and protruding blocks are formed on an outer wall of the cup rim sleeve;

a groove adapted to the protruding blocks is formed in an inner side wall of the outer cover, and a bottom side wall of the groove obliquely extends downwards to the bottom end of the outer cover; and when the outer cover covers the top of the cup body, the outer cover is rotated to allow the protruding blocks to move along the bottom side wall of the groove to be inserted into the groove to achieve fixed connection.

7. The detachable and washable cup lid according to claim 5, wherein, a cup rim sleeve is sleeved on a top of the cup body, and protruding blocks are formed on an outer wall of the cup rim sleeve;

a groove adapted to the protruding blocks is formed in an inner side wall of the outer cover, and a bottom side wall of the groove obliquely extends downwards to the bottom end of the outer cover; and when the outer cover covers the top of the cup body, the outer cover is rotated to allow the protruding blocks to move along the bottom side wall of the groove to be inserted into the groove to achieve fixed connection.

8. The detachable and washable cup lid according to claim 7, wherein, the outer cover is pressed and rotated to allow the protruding blocks move along the bottom side wall of the groove to be inserted into the groove, the elastic leakage-proof sleeve is tightly attached to the circle of waterproof band to generate an upward counter-acting force to provide an overall upward acting force for the outer cover, and then the protruding blocks is allowed to be tightly attached to the groove of the outer cover.

* * * * *